US012054952B2

(12) United States Patent
Melling

(10) Patent No.: US 12,054,952 B2
(45) Date of Patent: Aug. 6, 2024

(54) CABLE RAILING WITH TENSIONING DEVICE

(71) Applicant: Raymond B. Melling, Manhattan, MT (US)

(72) Inventor: Raymond B. Melling, Manhattan, MT (US)

( * ) Notice: Subject to any disclaimer, the term of this patent is extended or adjusted under 35 U.S.C. 154(b) by 183 days.

(21) Appl. No.: 17/449,089

(22) Filed: Sep. 27, 2021

(65) Prior Publication Data

US 2022/0098870 A1 Mar. 31, 2022

Related U.S. Application Data

(60) Provisional application No. 63/203,721, filed on Jul. 29, 2021, provisional application No. 63/083,274, filed on Sep. 25, 2020.

(51) Int. Cl.
*E04F 11/18* (2006.01)

(52) U.S. Cl.
CPC ..... *E04F 11/1817* (2013.01); *E04F 11/1859* (2013.01); *E04F 2011/1831* (2013.01)

(58) Field of Classification Search
CPC ... E04H 17/127; E04H 17/161; E04H 17/163; E04H 17/17; E04H 17/24; E04F 11/1817; E04F 11/1851; E04F 11/1859; E04F 11/1861; E04F 2011/1831
See application file for complete search history.

(56) References Cited

U.S. PATENT DOCUMENTS

| | | | | | |
|---|---|---|---|---|---|
| 153,390 | A * | 7/1874 | Speakman | E04H 17/163 | 256/31 |
| 4,730,809 | A * | 3/1988 | Stoler | E04H 17/127 | 200/61.93 |
| 6,135,424 | A * | 10/2000 | Bracke | E04H 17/1417 | 256/65.01 |
| 2006/0151760 | A1* | 7/2006 | Vyvyan-Vivian | B25B 25/00 | 254/231 |
| 2009/0050865 | A1* | 2/2009 | Napier | E04F 11/1853 | 256/37 |
| 2012/0168703 | A1* | 7/2012 | Napier | E04F 11/1842 | 256/37 |

FOREIGN PATENT DOCUMENTS

| | | | | |
|---|---|---|---|---|
| KR | 20090009249 U | * | 9/2009 | |
| WO | WO-2006105591 A1 | * | 10/2006 | E04F 11/1812 |
| WO | WO-2011009162 A1 | * | 1/2011 | E04F 11/1842 |

* cited by examiner

*Primary Examiner* — Jonathan P Masinick
(74) *Attorney, Agent, or Firm* — Spencer Fane, LLP

(57) ABSTRACT

A railing system is provided. The railing system can include a panel coupled to a post or wall with a tensioning device. The panel can include one continuous strand of cable threaded through, back and forth, two loom members. The loom members can be designed or configured to organize the cable so that the distance between each strand does not exceed spacing requirements in the building codes for railing balusters.

20 Claims, 20 Drawing Sheets

FRONT VIEW

BOLT PIVOT

REAR VIEW

CABLE RAILING WITH TENSIONING DEVICE

CROSS REFERENCE TO RELATED APPLICATIONS

The present application claims priority to U.S. Provisional Patent Application No. 63/203,721, filed Jul. 29, 2021, entitled "CABLE SPREADER AND TENSIONING DEVICE FOR RAILINGS," and to U.S. Provisional Patent Application No. 63/083,274, filed Sep. 25, 2020, entitled "CABLE SPREADER AND TENSIONING DEVICE FOR RAILINGS." Both of these applications are incorporated herein by reference, in their entirety, for all that they teach and for all purposes.

DETAILED DESCRIPTION

Figure 1A:
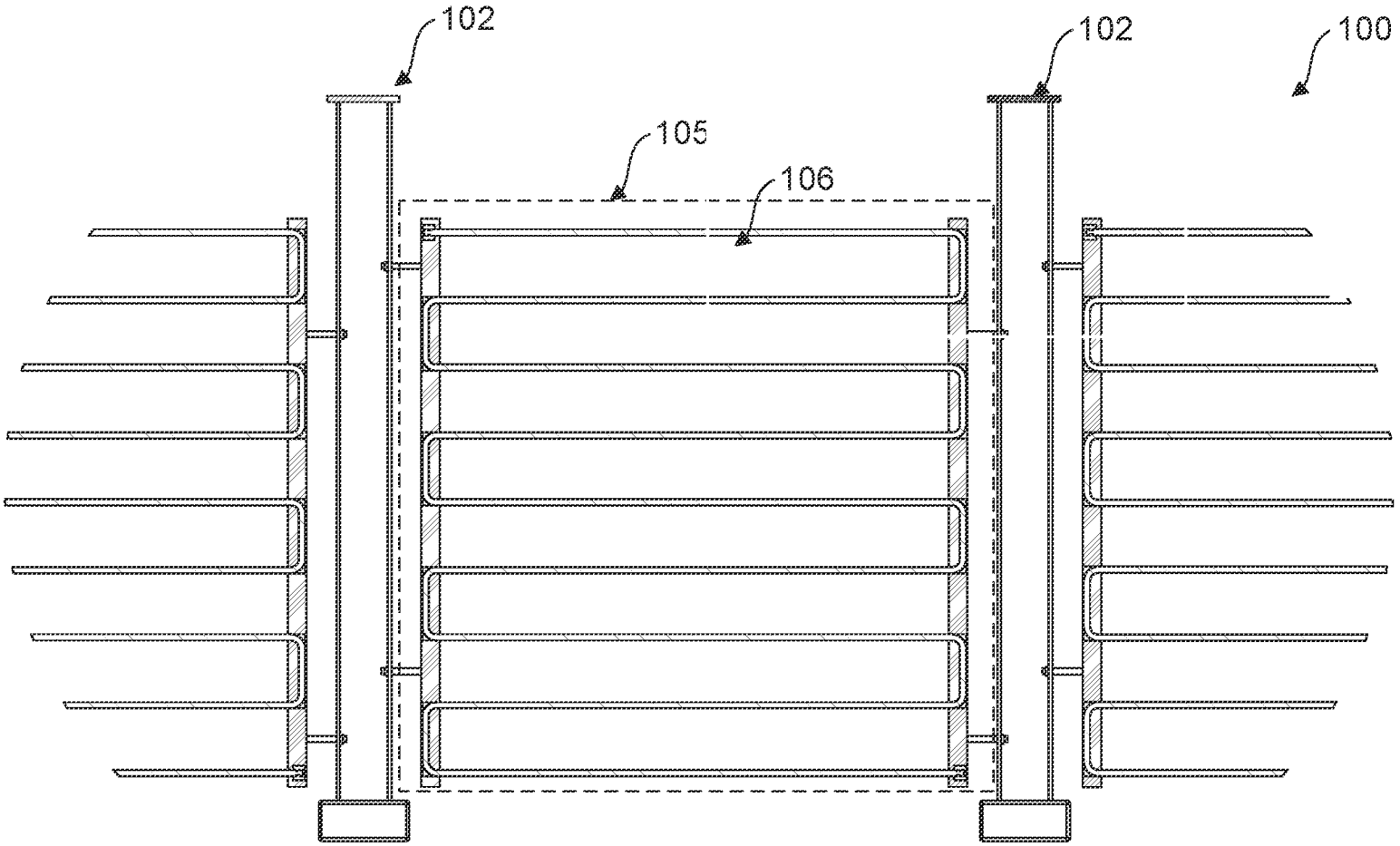
FIG. 1A depicts an example of a railing system in accordance with examples of the present disclosure.

Aspects of the disclosure relate to a railing system. The railing system can include a tensioning device. This tensioning device can include one continuous strand of cable, wire rope, or similar (hereafter referred to as "cable" or "wire"), to be threaded through, back and forth, two loom members, to create a railing "panel". The loom members can be designed or configured to organize the cable so that the distance between each strand does not exceed spacing requirements in the building codes for railing balusters.

Two loom members can be used to thread the cable(s) through, one loom member can be placed on each "end" of the panel. The loom member can further incorporate the ability to secure one of the loose ends of the cable within or at each loom member. To secure the panel, the loom member may include threaded bolts, screws, or similar, to anchor the cable panel between structures, for example, railing posts. Once the loose cable ends are secured, the anchors may act as the tensioning device, which may be tightened to tension the cables. The cable is routed between the loom member in such a way that, as the anchors apply tension, the cable is able to pass through the loom members so that even tension is applied to each cable portion or "loop". This equal tension can provide, at least, the advantage of being able to tension an entire panel of cable at once, with even tension automatically applied to each cable loop, rather than having to tighten each individual strand.

When appropriate anchors and railing posts are used, the tensioning device can apply greater tension, approaching the working load limits of the cable, (without cable slippage or release). The tension applied may be greater than many common cable railing devices currently available. This added tension, in turn, can allow for higher levels of use/abuse, i.e., climbing of cables or absorbing impacts (e.g., from people falling into the cables), without failure. Also, in the event of that the cable(s) do stretch and the panel is not tensioned fully or adequately, the existing cable can easily be re-tensioned by retightening the anchors.

A pair of the railing looms may be provided to create individual railing panels, one pair of tensioning devices may be provided for each railing loom. In at least some implementations, the railing posts may be constructed or altered to allow the cable to be threaded through one or more posts, in a straight line or around corners. In this case, one pair of tensioning devices can be provided to organize and stretch cable through multiple railing posts or panels.

The cable ends can be secured or held by the loom members. To hold the cables, a device, e.g., a swaged button stop ferrule or similar, may be applied to each cable end. Then, the device is inserted and held in a hole or pocket of the loom member. As tension is applied to the device, via anchors, the cable end device is drawn into the pocket but not allowed to pass through the pocket (e.g., the pocket or hole diameter is sized for button stop but the end of the pocket is smaller than the button stop). The pocket can conceal the button stop, and the cable attached to the button stop can pass through on the other side of the loom member (e.g., on the cable-panel-side of the loom member). The slack in the cable required to install the button stop may be evenly distributed through the rest of the cable loops during tensioning. As the tensioning devices apply tension, the cable is drawn through the loom members, applying even tension to each strand of cable.

The loom member user one each side of the panel may be identical. However, one of the loop members may be rotated 180 degree, that is, may be used upside down. Thus, the pocket for securing the loose cable end may be at the top on one side of the cable panel, and at the bottom on the other side of the panel. With this configuration, there is only loom member to manufacture for both sides of the panel; the loom member is universal in application. Also, a loom member is when on opposing sides of a rail post, or at a corner post, the tensioning devices do not align because one of the loom members is inverted and the tensioning devices are offset. Thus, the tensioning devices can be separated far enough apart from each other that the tensioning devices do not intersect, collide, or interfere with the operation of each other inside the post.

In instances where an even number of cable loops are required to meet a desired cable spacing and panel height, modifications to the loom members may be made. For example, both cable ends may be secured on the same loom member. The other loom member may include cable paths but no pocket to secure the cable ends. This change to the design can locate the tensioning devices back to back, on opposing sides of a single rail post, with no interference of the tensioning devices.

This railing system creates a unique appearance among cable railings, in that each cable does not touch, pierce, or bisect every post. In fact, this can be installed so that no cable touches any post, thereby breaking up the horizontal lines of the cables with the vertical posts, and creating individual cable railing panels that are independent of the posts.

This railing system can also have at least some significant improvements over previous cable railing designs of other railing systems (e.g., wooden, welded steel, iron, etc.). First, the cables can loop freely through the back of the loom member (allowing the cables to slide freely), rather than weaving back forth. Weaving the cables rather than looping those cables can cause the cables to bind and kink, which makes the installation of the cables more difficult. Also, the anchor bolts can be welded to the tensioner and require access to the nut that tensions the device. This design can cause the anchor to protrude through railing posts or require a large enough hole be provided on the far side of the rail post to allow tools to access the tensioning nut. The aspects described herein allow for the tensioning bolt to be turned so that the nut can be fixed in or on the adjacent railing post or anchoring structure.

Figure 1B:
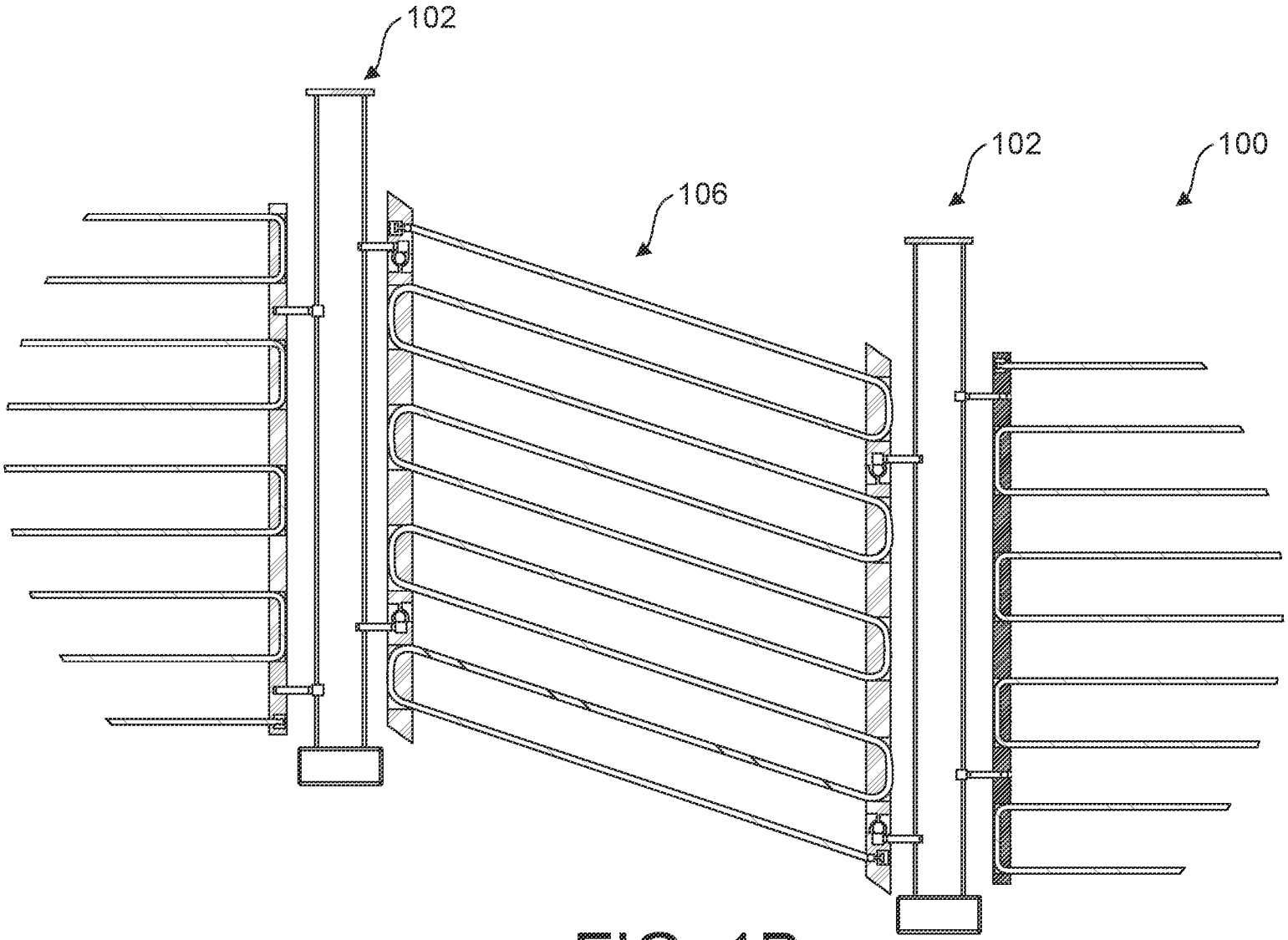
FIG. 1B depicts another example of a railing system in accordance with examples of the present disclosure.
Figure 1C:
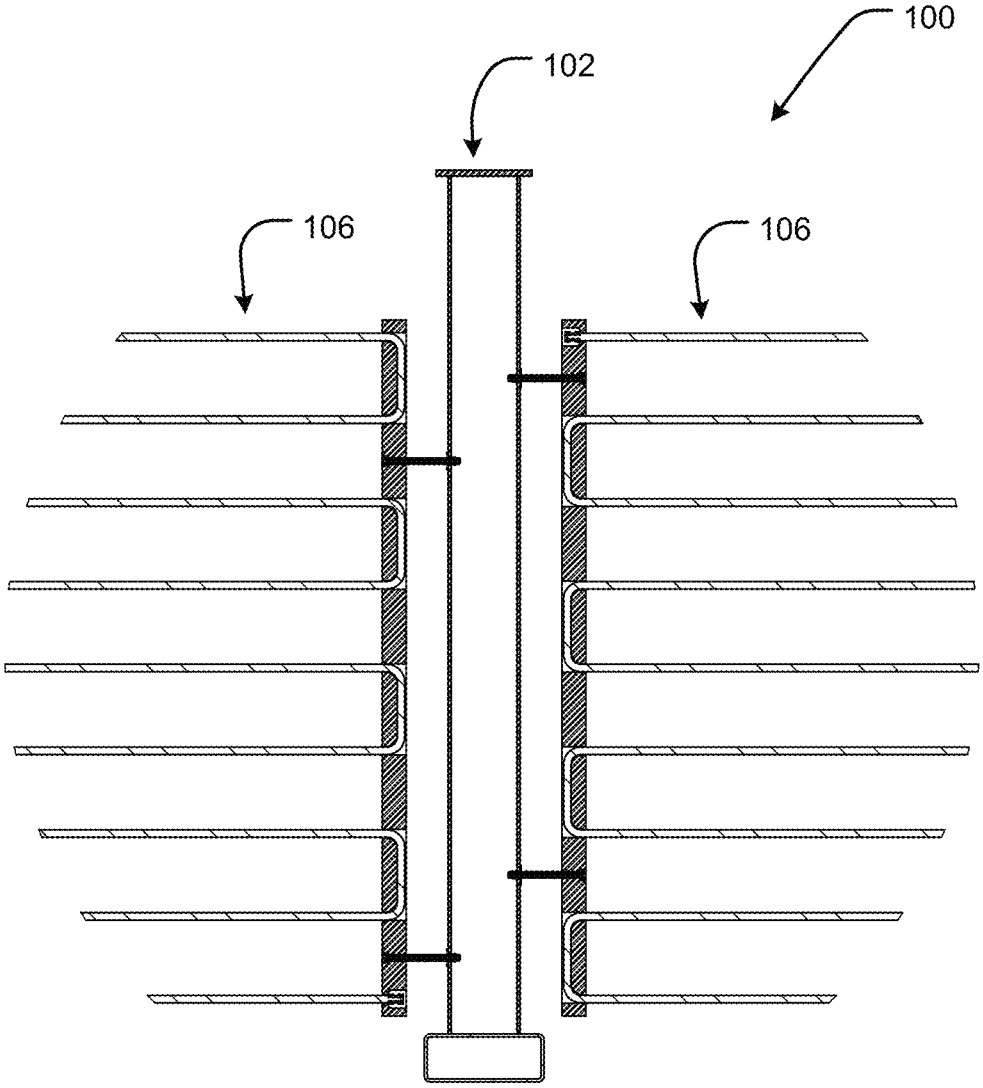
FIG. 1C depicts another example of a railing system in accordance with examples of the present disclosure.
Figure 4:
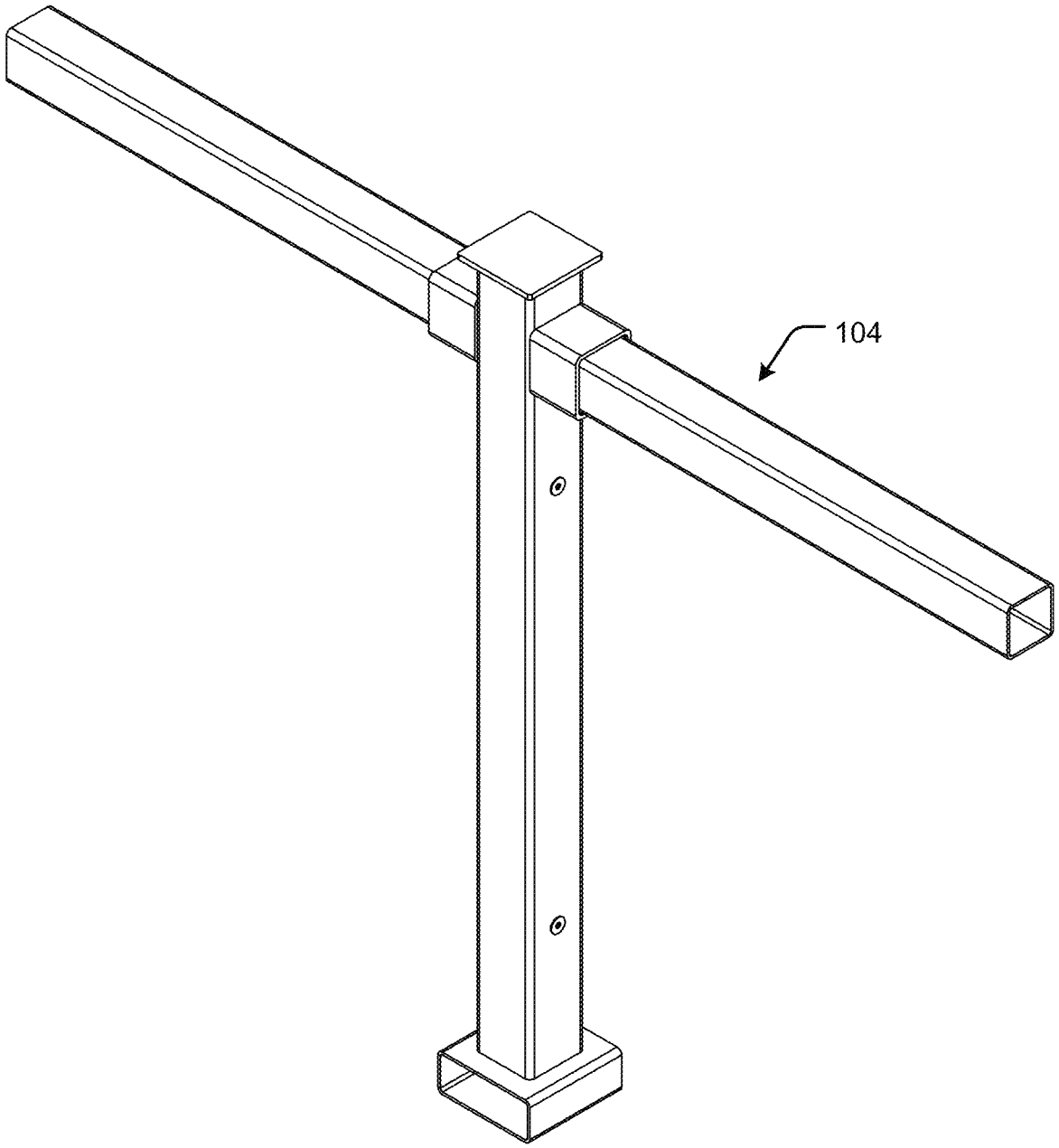
FIG. 4 depicts another example post of the railing system in accordance with examples of the present disclosure.

An implementation of the railing system 100 maybe as shown in FIGS. 1A, 1B, and 1C. The railing system 100 can include an anchoring point, e.g., a post 102 or wall end, at each end of the paneling system 106. The panel 106 can span the gap 105 between the anchoring points e.g., the posts 102. The railing system 100 may also include a top rail 104, which may be as shown in FIG. 4. The paneling system 106 can comprise one or more cables or wires and one or more loom members forming the panel 106. An example of the paneling system 106 may be as shown in FIG. 2.

Figure 2:
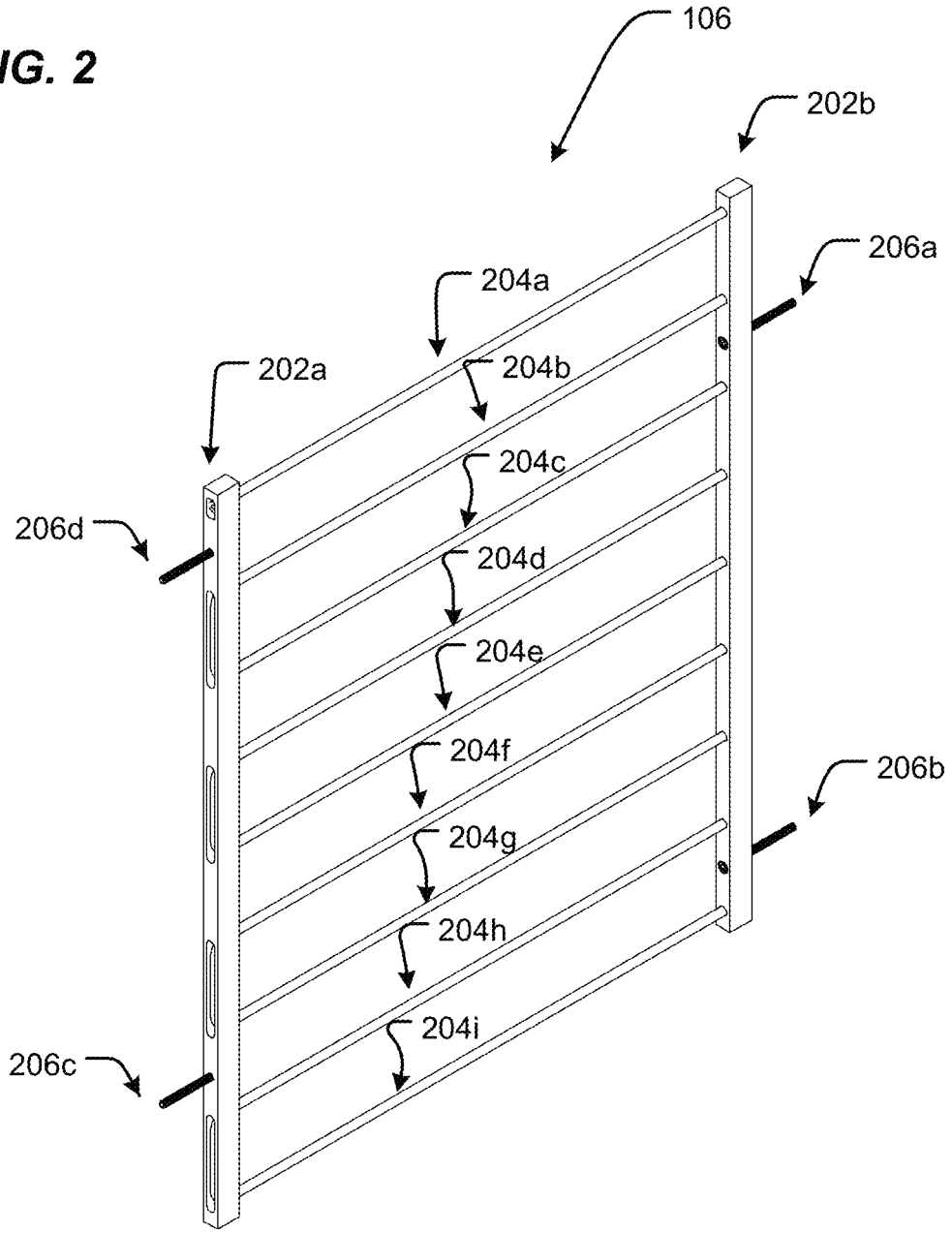
FIG. 2 depicts an example panel section of the railing system in accordance with examples of the present disclosure.

Referring to FIG. 2, the panel 106 can include one or more loom members 202*a*, 202*b* that may be coupled to the post 102*a*, 102*b* (or other anchoring point). A coupling between the loom members 202 and the post 102 may include a tensioning device 206*a*, 206*b*, 206*c*, and/or 206*d*. The tensioning device 206 can be a bolt that is inserted through a hole or aperture in a loom member 202 and then screwed into a tapped hole in the post 102. The tension applied by the two or more tensioning devices 206 can ensure substantially equal tensioning of the cables between the loom members 202. The tensioning devices 206 can be hardened, rigid, etc. with high tensile strength to ensure the threads of the tensioning devices 206 are not stripped when used. In at least some examples, the tensioning devices 206 are metal, e.g., stainless steel, steel, aluminum, or other metal.

The gap 105 between the loom members 202*a* and 202*b* maybe spanned by one or more cables or wires 204*a*, 204*b*, 204*c*, 204*d*, 204*e*, 204*f*, 204*g*, 204*h*, and/or 204*i*, etc. The cables or cables 204 may be braided metal strand cables or other types of cables. The length of the cable(s) 204 and the gap between the cable(s) 204 may be determined by the height of the railing system and based on any laws or rules acquiring a certain distance or maximum distance between the cables 204. In one configuration, each cable 204*a*-204*i* may represent a single cable that is terminated at each end at the first loom member 202*a* or the second loom member 202*b*. In another configurations, cables 204*a*-204*i* are a single cable terminated at a top of a member 202*a* and at the bottom of loom member 202*b*. This single cable 204 can be threaded or woven between the loom members 202, back and forth, to provide the various cable spans 204*a*-204*b* in the panel 106.

Figure 3:
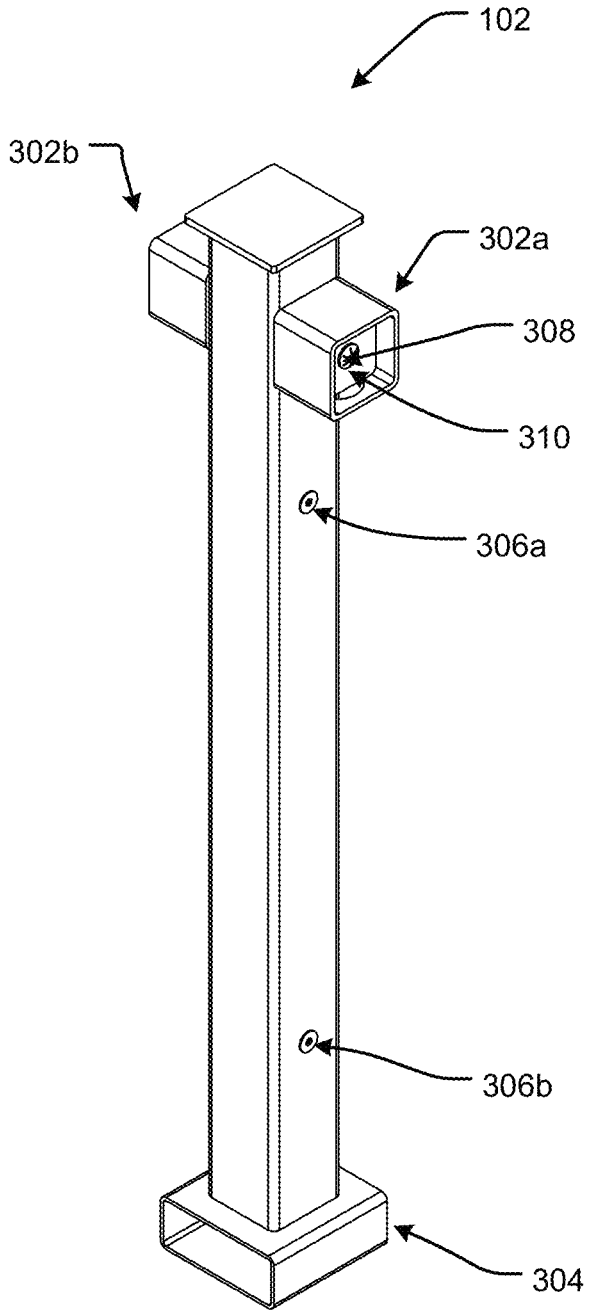
FIG. 3 depicts an example post of the railing system in accordance with examples of the present disclosure.
Figure 5:
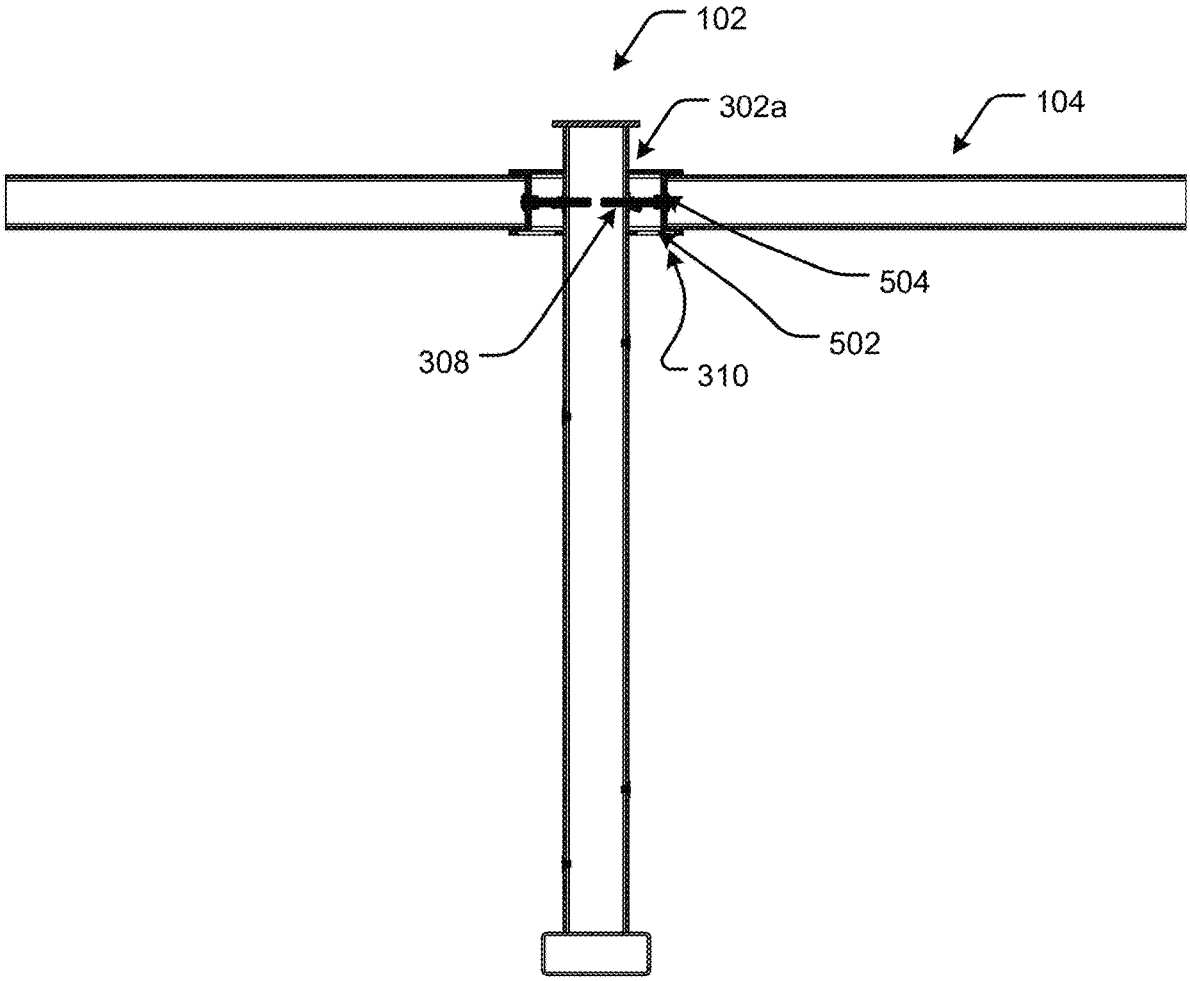
FIG. 5 depicts another example post of the railing system in accordance with examples of the present disclosure.

Example implementations of a post 102 and/or top rail 104 maybe as shown in FIGS. 3-5. The railing system 100 can include a top, rigid top railing 104. A railing acceptor 302*a*, 302*b* can accept the top rail 104. This railing acceptor 302 may be bolted or coupled to the post 102 with a coupling device 308 inserted through a back flange 310. In at least some configurations, the coupling device 308 may be a bolt inserted through the flange 310 and into the post 102. A railing 104 may be inserted into the railing acceptor 302. The railing may then have its fit tightened by the tension provided by the panel 106. The railing 104 may be rigid, for example, may be made from metal or other material that resists deflection. The railing acceptor 302 may also be rigid and made from metal or other rigid material.

Post 102 may also be rigid and resist deflection. For example, the post 102 may be wood or metal. The post 102 can also include one or more tapped holes 306*a*, 306*b* on opposing sides 312 the post 102. These holes 306 accept the coupling/tensioning devices 206 inserted through the loom members 202. In at least some configurations, the tapped holes 306 accept the bolt 206 that can be screwed into the tapped hole 306. If the post 102 is wood, the tapped hole may be an insert, with a tapped hole, glued of affixed into a recess or aperture set or created in the post 102. In other configurations, the threaded holes 306 may be absent from a wooden post. In such configurations, the tensioning device 206 maybe a screw or through bolt that is screwed into or threaded to a nut on the other side of the wooden post 102 to tension the cables 204.

A configuration of the rail 104, as set into the railing acceptor 302 may be as shown in FIG. 4. The rail 104 can be inserted into the opening the aperture 302 and may contact the flange 310. When the cables 204 are tensioned, the tensioning can cause the rail 104 to be pulled into the rail acceptor 302 to ensure a tight fit between the railing 104 and the post. The railing 104 may be made out of metal, wood, or some other type of material. The length of the railing 104 may depend on the length of the 105 span between the posts 102, which may vary depending on the configuration of the posts 102 and the railing 104.

A cross sectional view of the post 102 and railing 104 assembly may be as shown in FIG. 5. The railing acceptor 304 can be seen with the flange 310 and the coupling device 308. For example, a coupling device 308, as shown, can be a bolt that threads through the flanged 310 into the post 102. The rail 104 can be inserted and can contact the flange 310. Thus, the rail end may not be inserted all the way to end of the railing acceptor 304 or to the post 102 but may stop at the flange 310. The rail 104 can span the gap between the posts 102 and may allow for the top rail 104 to be securely fashioned between and to the two posts 102*a*, 102*b*.

Figure 6:
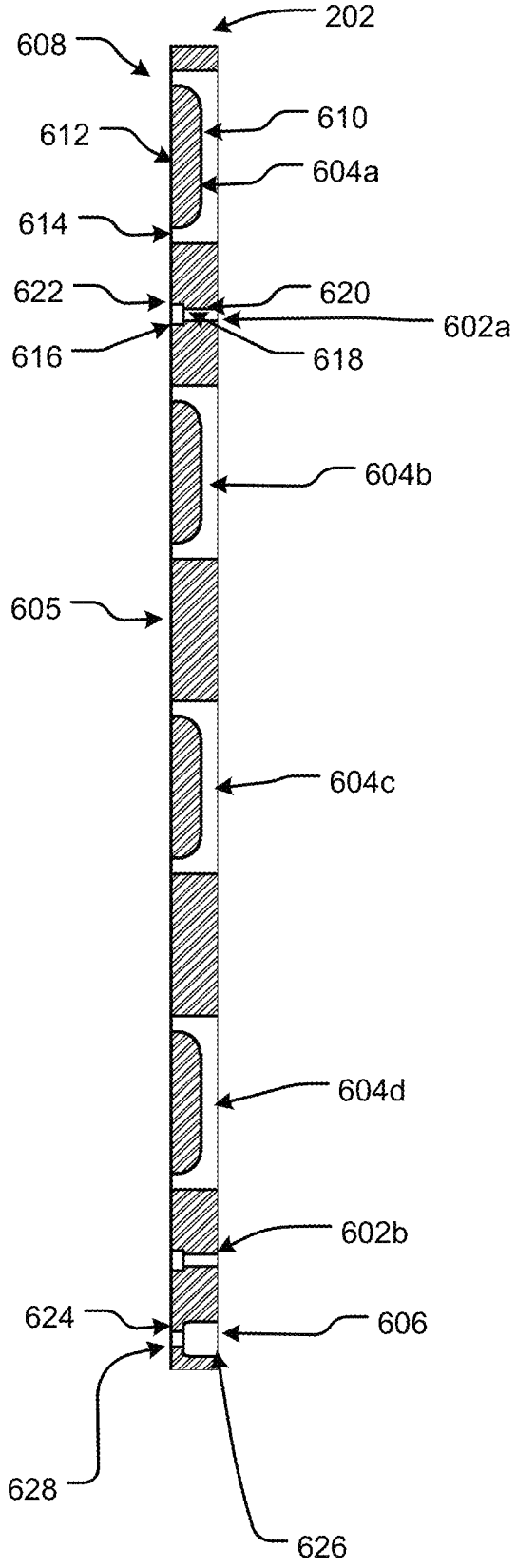
FIG. 6 depicts an example of a loom member of the railing system in accordance with examples of the present disclosure.
Figure 7:
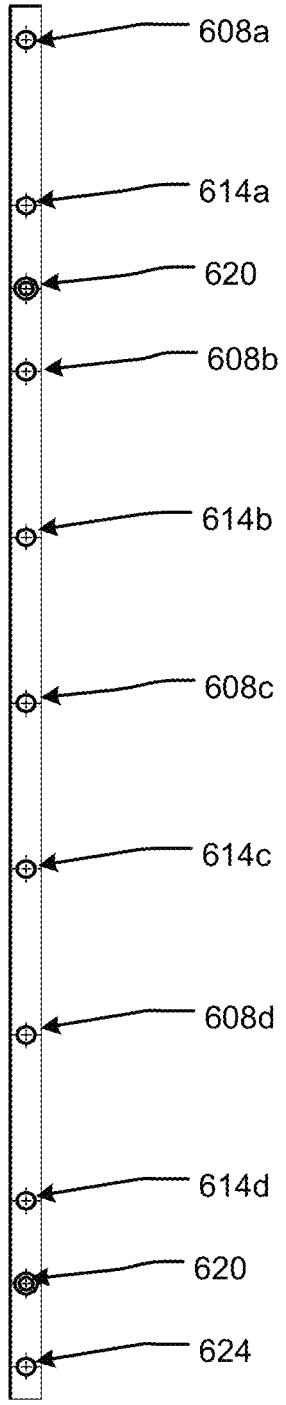
FIG. 7 depicts another example of a loom member of the railing system in accordance with examples of the present disclosure.
Figure 8:
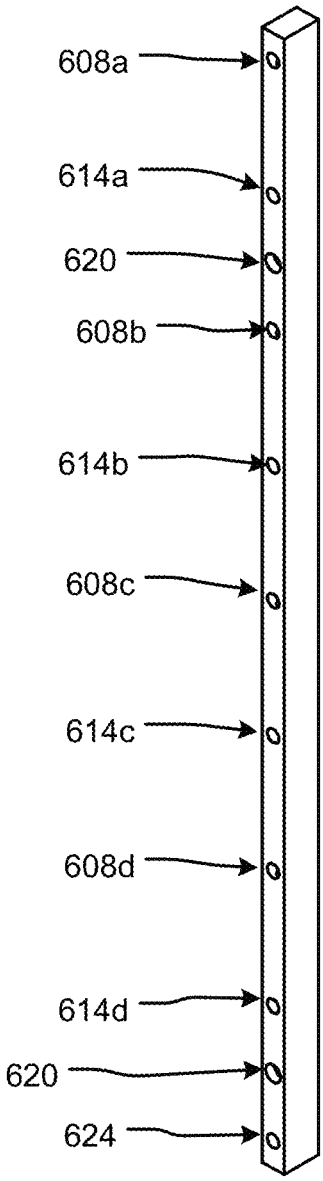
FIG. 8 depicts another example of a loom member of the railing system in accordance with examples of the present disclosure.
Figure 9:
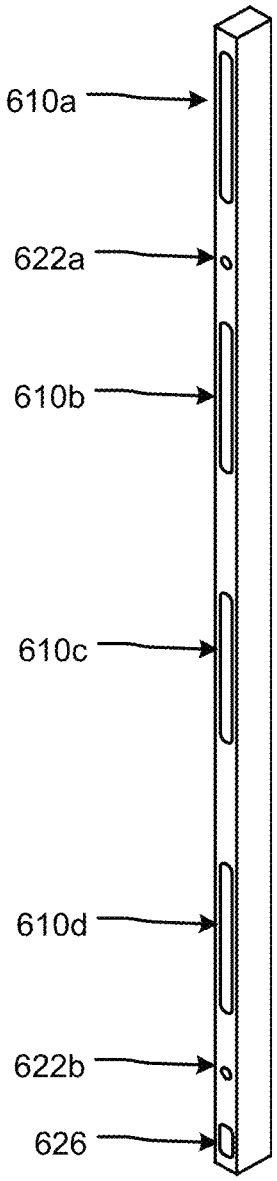
FIG. 9 depicts another example of a loom member of the railing system in accordance with examples of the present disclosure.
Figure 10:
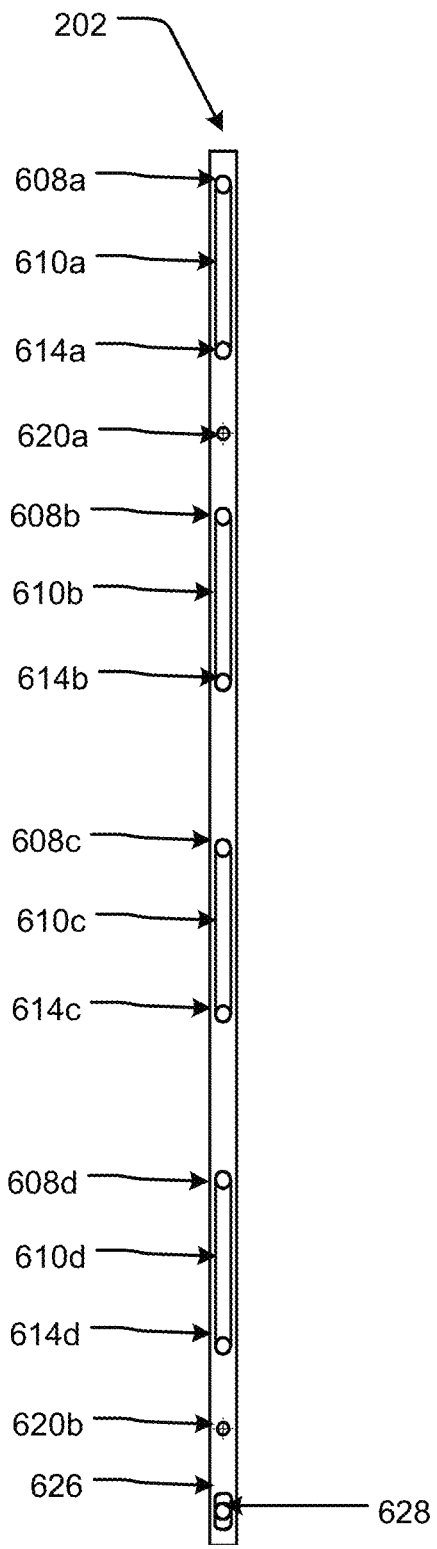
FIG. 10 depicts another example of a loom member of the railing system in accordance with examples of the present disclosure.

Loom member 202 may be as shown in FIGS. 6-10. The loom member 202 may be used for application of a horizontal panel 106 (as shown in FIG. 1A). A cross sectional view of the loom member 202 may be as shown in FIG. 6; a front view is provided in FIG. 7. An isometric view of the loom member 202 may be shown in FIG. 8 and FIG. 9. A back view of the loom member 202 is shown in FIG. 9 and FIG. 10. A loom member is a rigid member made from a material with good rigidity and tensile strength. For example, the loom member 202 may be made from metal (e.g., steel or aluminum), a composite, or similar materials.

One or more portions or sections may form the loom member 202. A first portion or section can be a full loom section 605 which includes only material without any machining, for example, no threading, no opening, etc., in this solid section of material. A next section maybe a cable u-shaped section 604*a* through 604*d*. The u-shaped section (s) 604 can accept a cable through an inlet opening 608. The cable 204 may be routed around and held against the u-shaped portion 610, with the cable 204 routed out of the outlet opening 614. U-shaped section 604 is formed from a material portion or u-shaped channel 612 that allows the cable to be looped around the solid material within the loom member 202. The u-shaped section 610 forms an opening or cut out that keeps the cable confined within the loom member 202 but allows access to the u-shaped section 604 and the cable through the back portion of the loom member 202.

Another portion 602*a*, 602*b* can include an opening or aperture that holds a tensioning device 206 attached to the loom member 202 and the post 102. The tensioning device 206 may be a bolt or similar to couple the loom member 202 to the post 102. The tensioning device 206 can be thread through an opening 618, in the loom member 202, and exit opening 620. Part of the tensioning device, e.g., a head of the bolt, may be retained in opening 622 and may be accessible through opening 616. The tensioning device 206 can be placed through the loom member 202 and coupled to the post 102. Aperture 616 can accept tools to tighten the tensioning device 206.

Another section of the loom number 202 can include a portion 606 to retain the cable end. The cable end retention section 606 includes larger aperture 626, which holds a retention device, e.g., a swaged button stop ferrule or similar, which ca be placed at and affixed to the end of the cable 204. The retention device may be affixed to the cable end by mechanical means, adhesive, etc. The opening 628 can allow the cable 204 to pass through an opening 624 to exit out the outlet 628. In this way, the cable 204 is retained by the loom member 202 and a tension can be applied by the loom member.

The cables 204 may be attached to the first loom member 202*a* at the first retention opening 606, which may be at the bottom of the panel 106. The second loom member 202*b* may be inverted with the opening 606 at the top and at the other side of the panel 106. The other end of the cable may then be captured within opening 620 at the top of the second loom member 202*b*.

The cables may be strung might be strong through the various different openings 608*a*-608*d* and 614*a*-614*d*. The openings 608, 614 and u-shaped sections 604 allow the cable to be threaded through the two loom members 202*a*, 202*b*, back and forth, to create the panel 106. The tensioning bolts may be accessed through the hole opening 606, from a front side, of the loom member 202. As shown in FIG. 8, the cables may be threaded through openings 610*a* through 610*d* in the backside of the loom member 202. Further, the retention device for the cable end and may be accessed through opening 626 in the back of the loom member 202. A single cable 204 may be used with the two loom members 202, without having to cut several sections for each cable length and have a retention device put on each end of each cable length, Rather, a single cable 204, with only two retention devices may be strung through the panel 106 forming a weave of the cable back and forth between the two loom members 202. This configuration can save time in constructing the panel 106 that can be attached to the post(s) 102.

Figure 11:
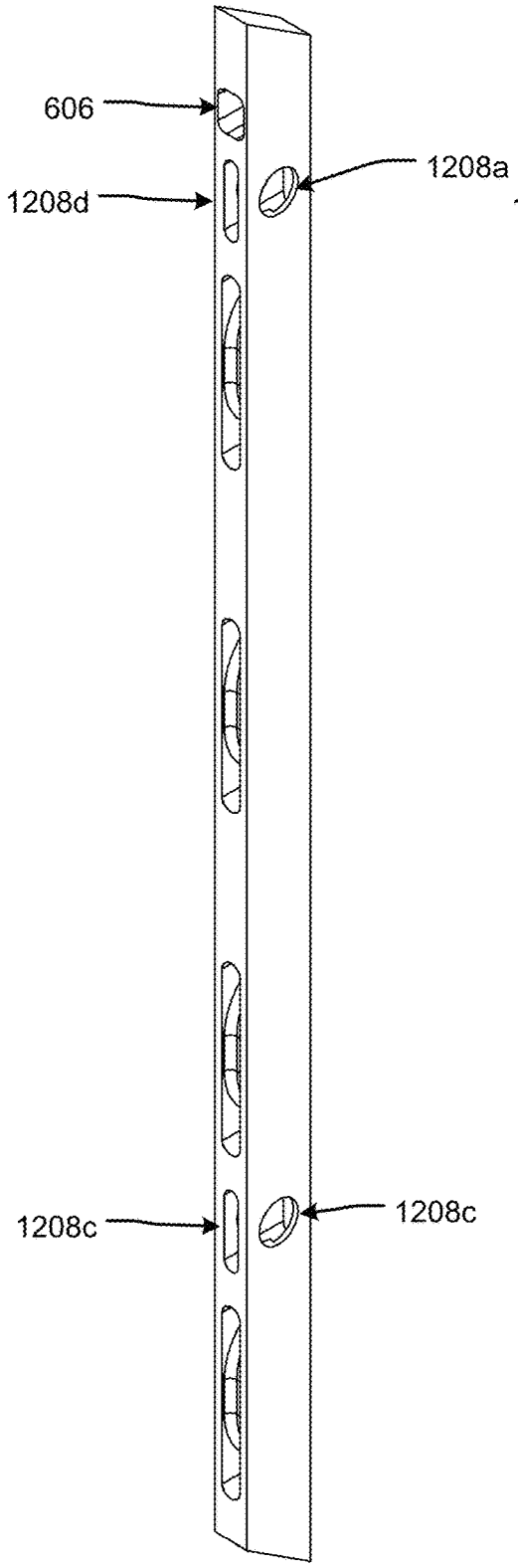
FIG. 11 depicts an example of a stair loom member of the railing system in accordance with examples of the present disclosure.
Figure 12:
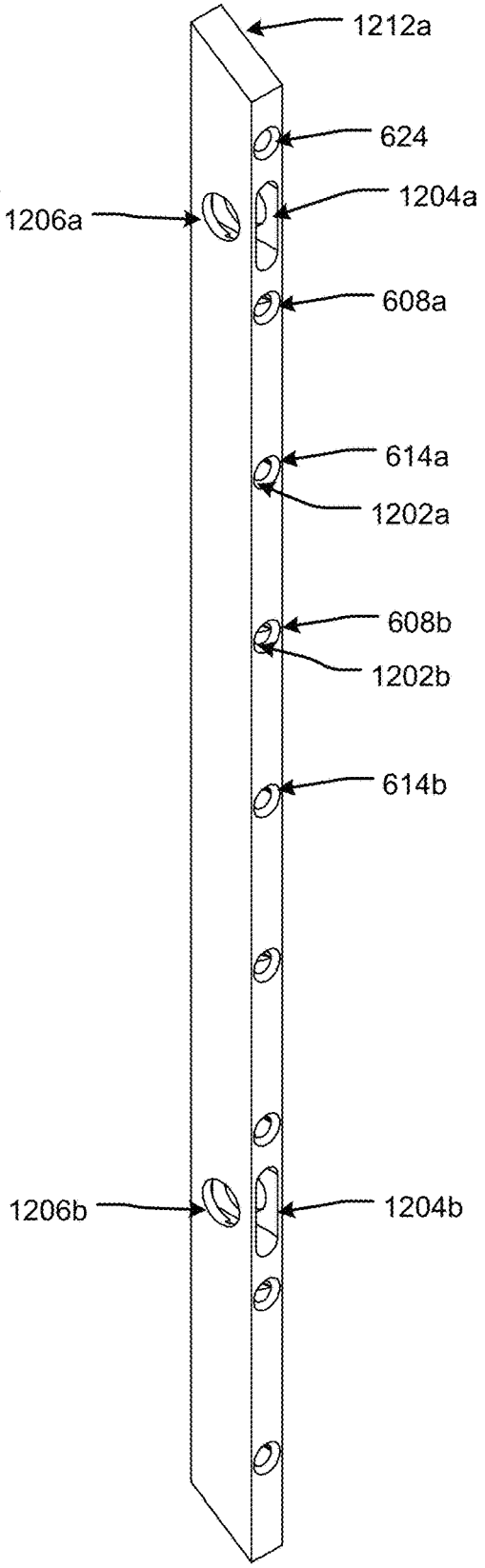
FIG. 12 depicts another example of a stair loom member of the railing system in accordance with examples of the present disclosure.
Figure 13:
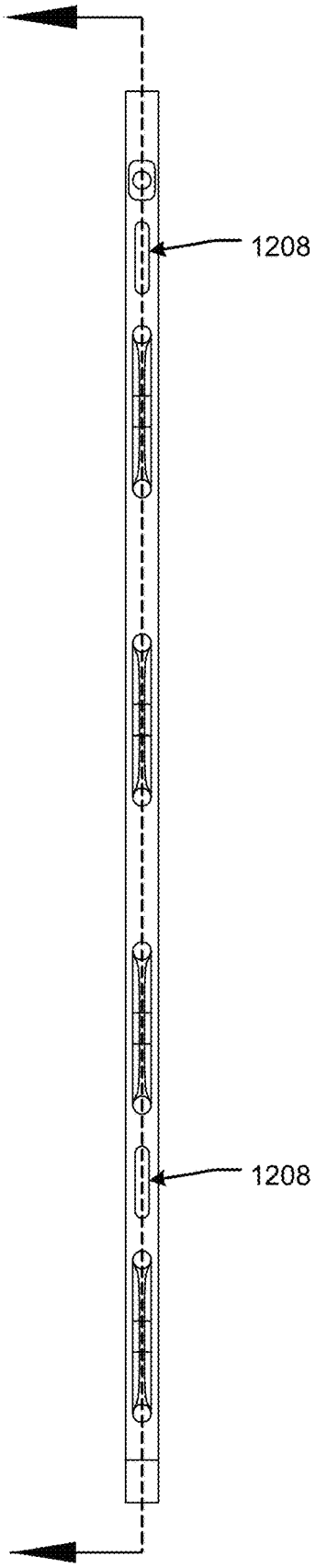
FIG. 13 depicts another example of a stair loom member of the railing system in accordance with examples of the present disclosure.
Figure 14:
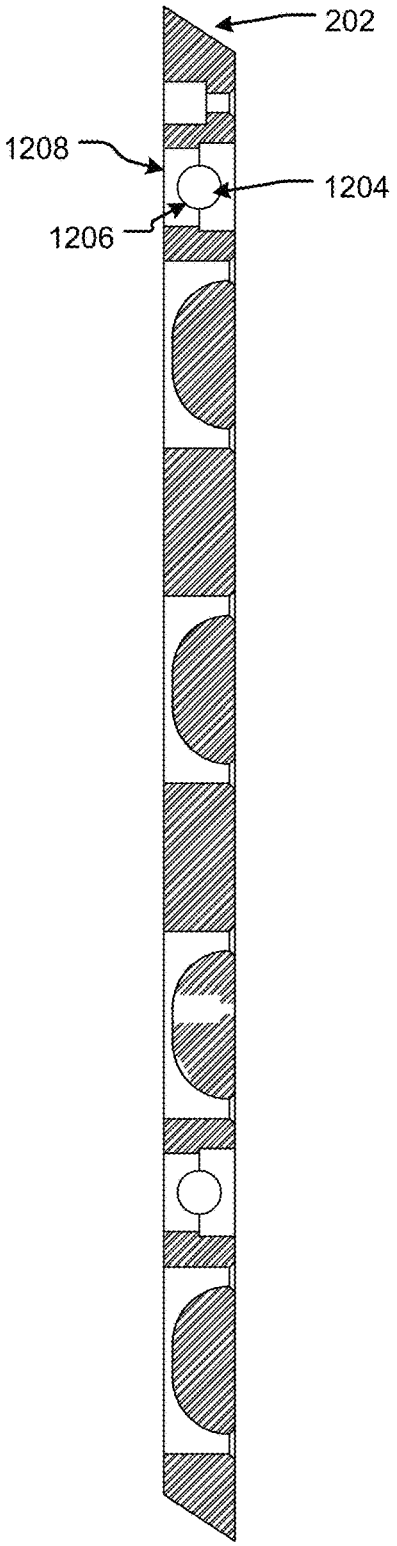
FIG. 14 depicts another example of a stair loom member of the railing system in accordance with examples of the present disclosure.
Figure 15:
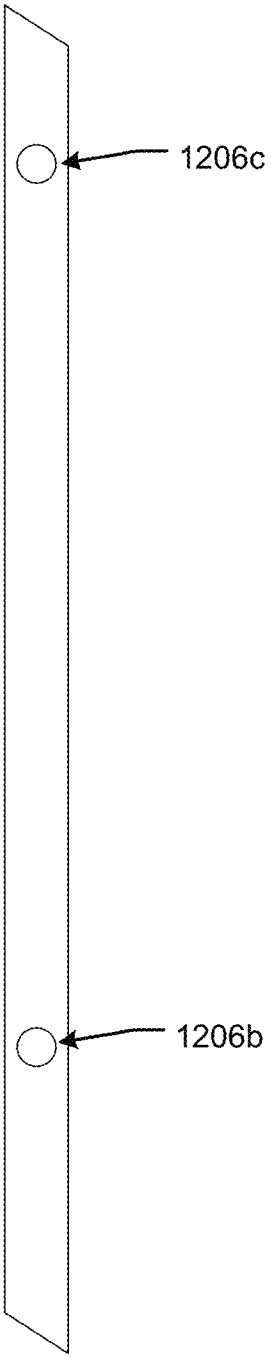
FIG. 15 depicts another example of a stair loom member of the railing system in accordance with examples of the present disclosure.
Figure 16:
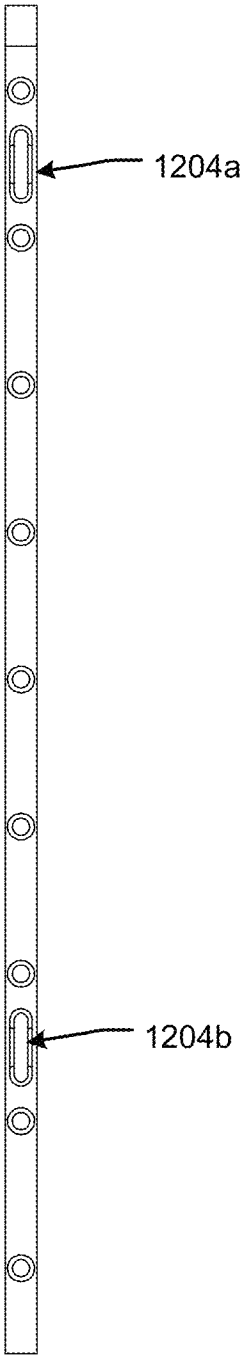
FIG. 16 depicts another example method associated with determining driver risk in accordance with examples of the present disclosure.

A second implementation of the loom member 202 may be modified for stair applications, as shown in FIGS. 11 through 16. FIG. 11 and FIG. 12 are isometric views of the stairway loom member 202 showing the backs and front of the stairway loom member 202. A view of the back elevation is shown in FIG. 13, while a cross sectional view of the stairway loom member 202 is shown in FIG. 14. A side view of the stairway loom member 202 is shown in FIG. 16, and a front view of the stairway loom member 202 is shown in FIG. 16. The stairway loom member 202 is similar to the horizontal loom member 202, However, differences between the two horizontal loom member 202 and the stairway loom member 202 will be described hereinafter.

Openings 608, 614 can have countersunk portions 1202*a*, 1202*b*, which may be a bevel at the edge of the opening 608, 614. The bevel 1202 reduces any strain on the cable 204 when the cable is strung diagonally (rather than at a right angle to the loom member 202) from the two loom members 202.

Elongated openings 1204 and 1208 are formed in the back of the stairway loom member 202 that change the access to the portion 602. The elongated openings 1204 and 1208 can allow the tensioning device 206 to pass through the stairway loom member 202 at an angle from stairway loom member 202 to the post 102. With this configuration, the stairway loom member 202 and the attached cables 204 can be tensioned at an angle or in a direction parallel to the cables on stairs. Further, the stairway loom member 202 may also have a bevel or angle at the ends 1212*a*, 1212*b*. This bevel angle may be decorative, however the bevel 1212 can provide a visual indicator of whether the bolts are mounted correctly when initially attaching the stairway loom member 202 or coupling the stairway loom member 202 to the post 102.

Stairway loom members 202 can have an aperture or opening 1206 provided through the side of the stairway loom member 202. This opening 1206*a*-1206*d* allows for a pivot bolt (see FIG. 21B) to slide through the side of the stairway loom member 202 and can then retain the tensioning device 206, e.g., a bolt, that may be attached to the post 102. The tensioning bolt 206 can rotate within the opening 1204, 1208 by rotating the pivot bolt in openings 1206. Thus, the tensioning bolt 206 can adjust to the correct angle and move within the stairway loom member 202, with the pivot bolt rotating within opening 1206, to apply tension at an angle similar to the angle of the cables 204.

Another view of the opening 1206 is shown in the cross section view of FIG. 14. The opening 1206 is through the openings 1204 and 1208, shown on the back and front side of the stairway loom member 202. These openings 1204 and 1208 are elongated spaces to allow for the tensioning device 206 to rotate and attach to the post 102 at an angle.

Figure 17A:
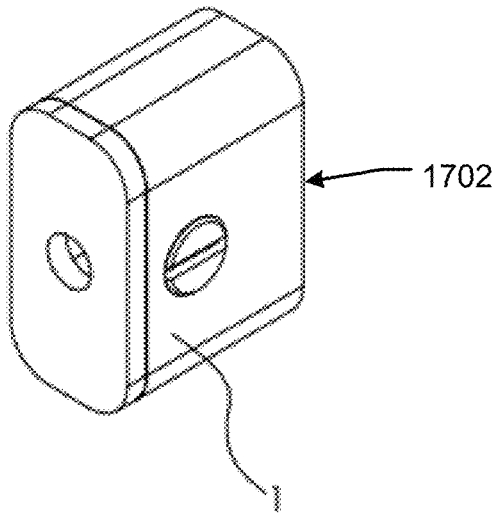
FIG. 17A depicts an example of a post attachment box in accordance with examples of the present disclosure.
Figure 17B:
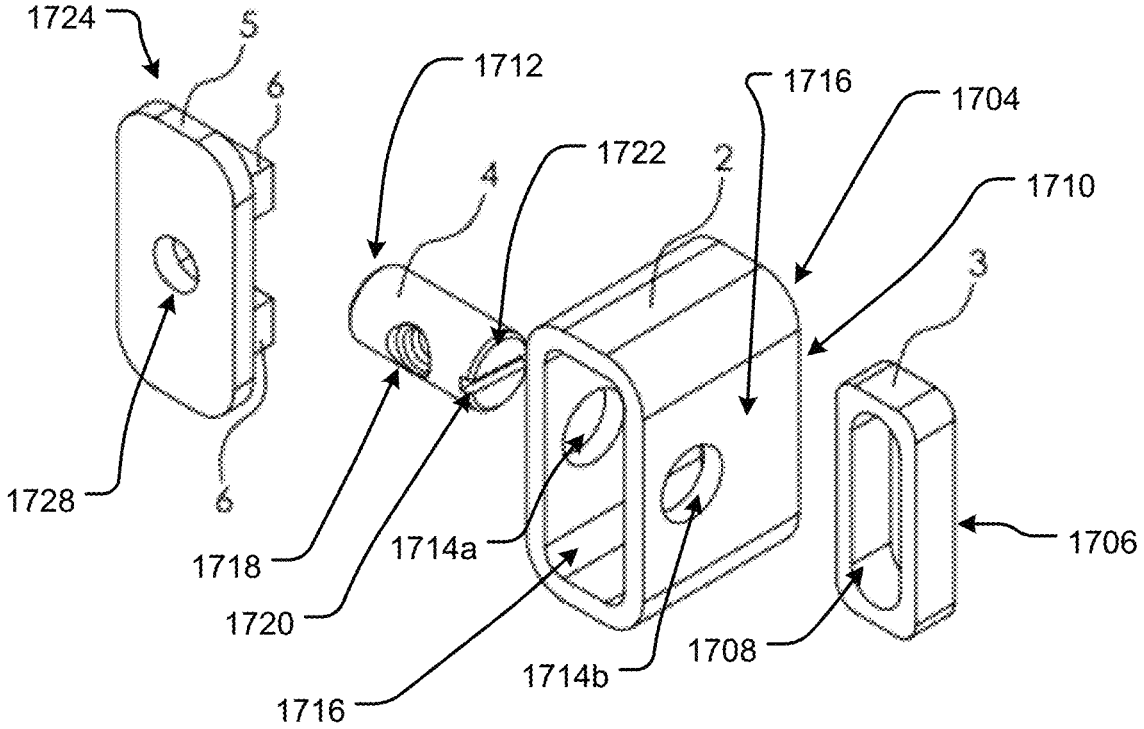
FIG. 17B depicts another example of a post attachment box in accordance with examples of the present disclosure.

Implementations of various retention or tensioning devices/attachments maybe as shown in FIG. 17 through FIG. 20. FIG. 17 shows a retention attachment 1702 that can include various parts that can be attached to a post 102, whether that post 102 is wooden or metal. The attachment device 1702 can include an attachment box 1704. The attachment box 1704 may be coupled or attached to the post 102, for example, using panel 1706, which may include an opening 1708. This opening 1708 may allow for a screw, bolt, or other attachment member to be driven or placed through the back panel 1706 and through or into the post 102. The attachment member may be a screw driven into a wooden post through this panel 1706. In other implementations, a threw bolt may be placed through the post 102 and the back flange 1706. The back flange 1706 may be welded to the retention box 1704 at the back 1706 the attachment box 1704.

An anchor nut 1712 may then be inserted through one or more openings 1714*a* and 1714*b* through the sides 1716 of the retention box 1704. In implementations, the anchor nut 1712 is a barrel nut with a tapped hole 1718 in the side of the barrel nut 1712. A slot 1720 in the end 1722 of the barrel nut 1712 accepts a screwdriver tip that allows for the adjustment of the orientation of the barrel nut 1712 in relation to the retention box 1704. The tapped hole 1718 can accept the bolts 206 or another tensioning device from loom member 202.

The outer covering 1724 may be placed within the opening 1726 of the retention box 1704. The covering 1724 can include a hole 1728 that allows the bolt 206 to pass through the covering 1724 and be inserted into the hole 1718. The configuration shown in FIG. 17B may be for the straight panel shown in the FIG. 2. In other implementations, the hole 1728 may be elongated along the length of the cover 1724. This configuration may allow for the attachment of the bolt 206 at an angle for attaching the stairway loom member 202 to a post 102.

Figure 18A:
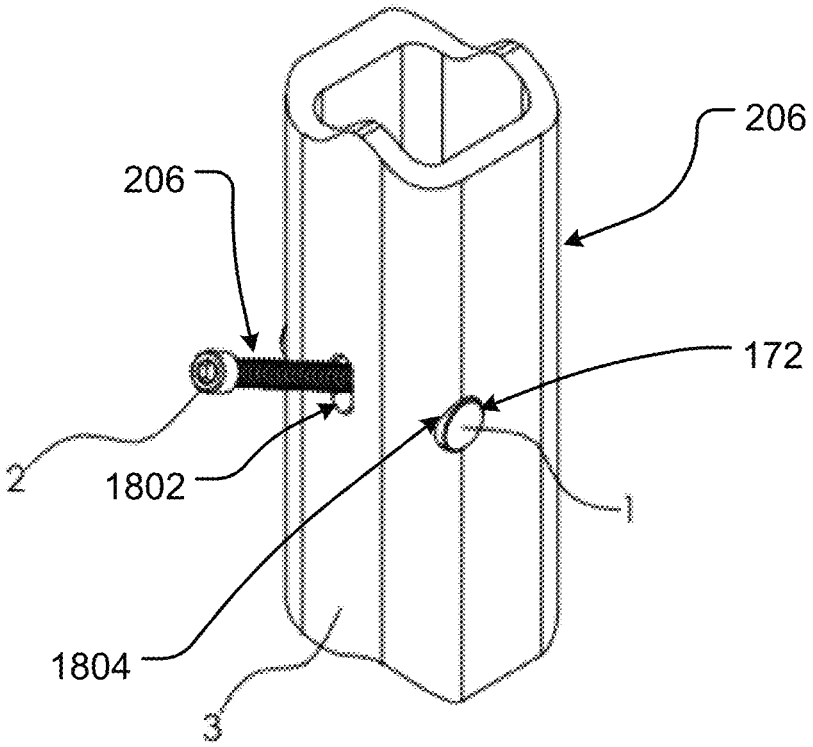
FIG. 18A depicts an example of a post attachment device in accordance with examples of the present disclosure.
Figure 18B:
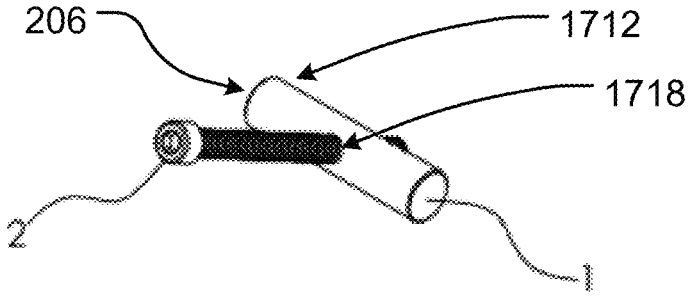
FIG. 18B depicts another example of a post attachment device in accordance with examples of the present disclosure.

An implementation of a post 102 may be shown in FIG. 18A. The tensioning bolt 206 can be inserted through aperture or opening 1802 in the post 102. Then, the tensioning bolt 206 can be screwed into a tapped hole 1718 in the anchor nut 1712, shown inserted through an opening 1804 in the side of the post 102. This opening 1804 may be formed through each side of the post 102. This hole 1804 allows the anchor nut 1712 to rotate when accepting the bolt 206. Thus, the bolt 206 may be oriented with an angle compared to the post 102 and need not be perpendicular to the post 102. The hole 1804 may also be elongated along the length of the post 102. A configurations of the anchor nut 1712 may be shown in FIGS. 18B and/or 18B. The anchor nut 1712 can include a hole 1718. The anchor knot 1712 may be barrel shaped with the hole 1718 formed through the side of the anchor nut 1712 to accept the tensioning bolt 206.

Figure 19C:
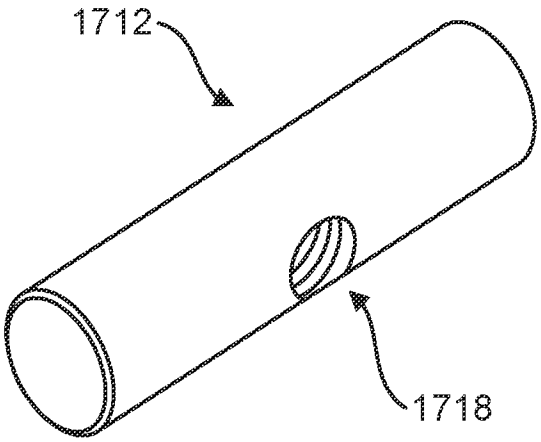
FIG. 19C depicts another example of a post attachment nut in accordance with examples of the present disclosure.
Figure 19B:
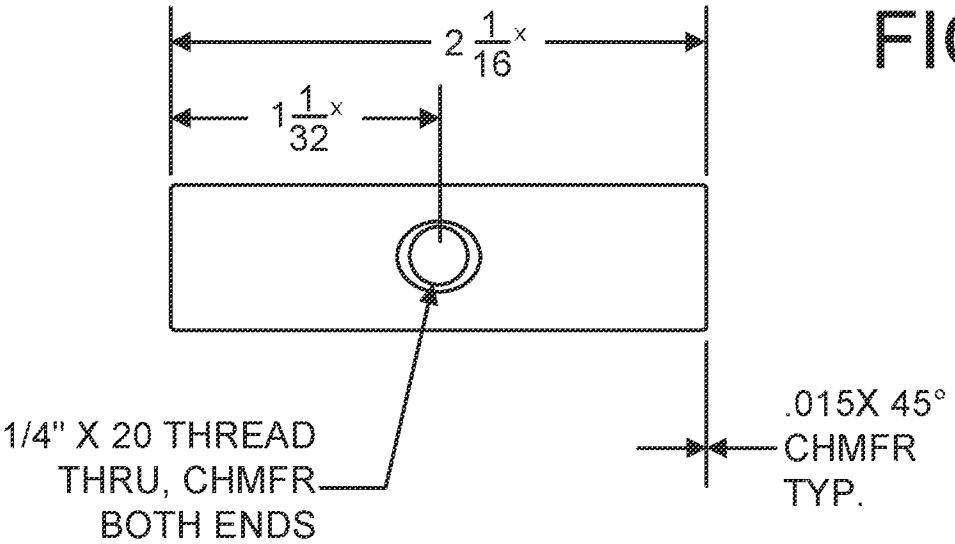
FIG. 19B depicts another example of a post attachment nut in accordance with examples of the present disclosure.
Figure 19A:
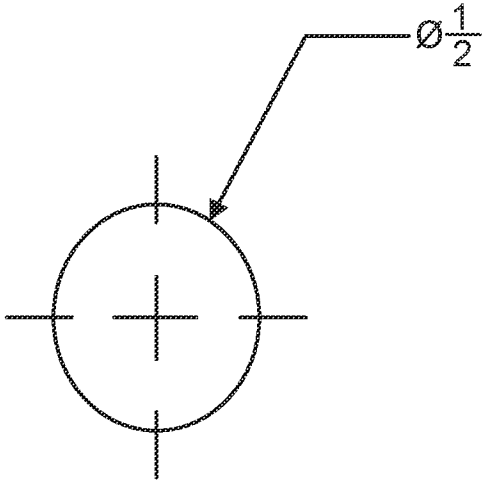
FIG. 19A depicts an example of a post attachment nut in accordance with examples of the present disclosure.
Figure 20:
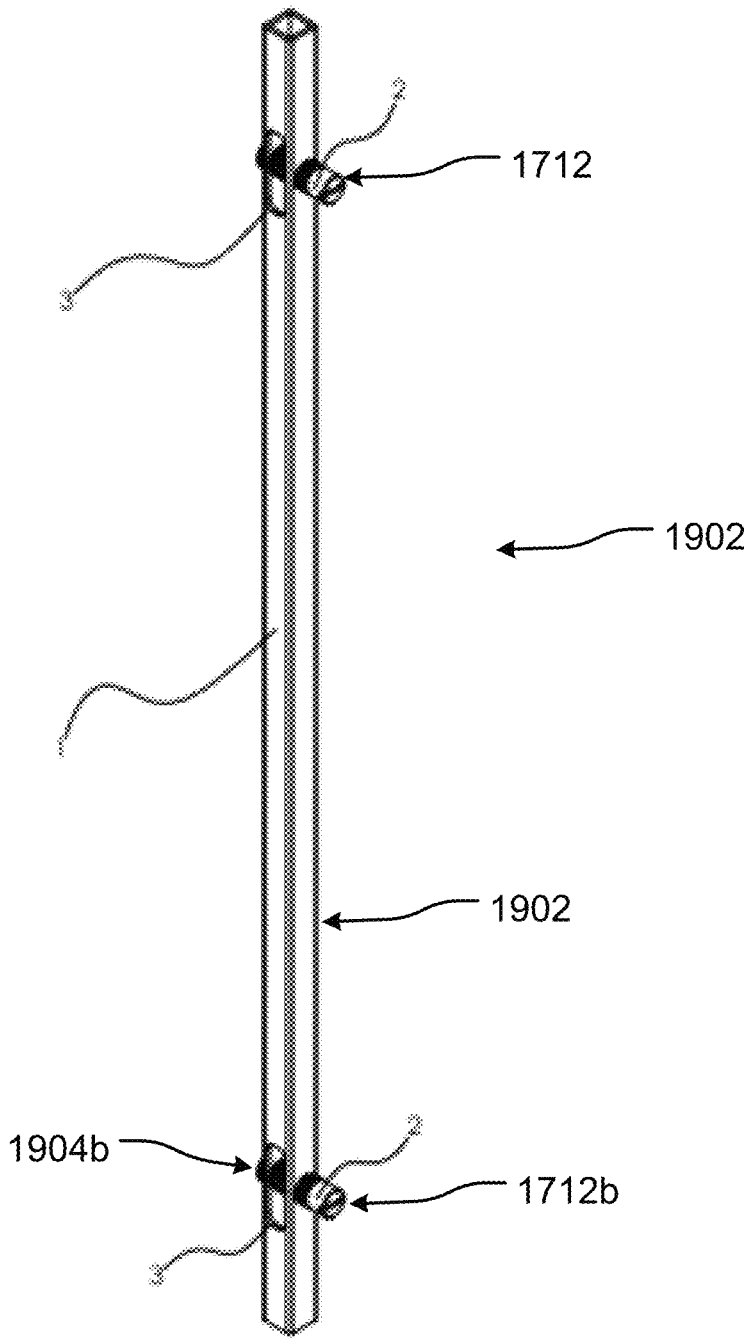
FIG. 20 depicts an example of a loom attachment member in accordance with examples of the present disclosure.

An implementation of an internal loom anchor 1902 may be shown in FIG. 19. The internal loom anchor 1902 may be provided or placed within the inside the post 102. The insert internal loom anchor 1902 can accept the anchor nuts 1712*a* and 1712*b* to retain and/or tension the loom member 202. Opening 1904*a* and 1904*b* provide access to the anchor nuts 1712*a* and 1712*b* to couple the bolts 206 by threading the bolts 206 into the holes 1718 of the barrel nuts 1712. The internal loom anchor 1902 may be placed within the posts 102 to allow for the connections to the loom member 202.

Figure 21A:
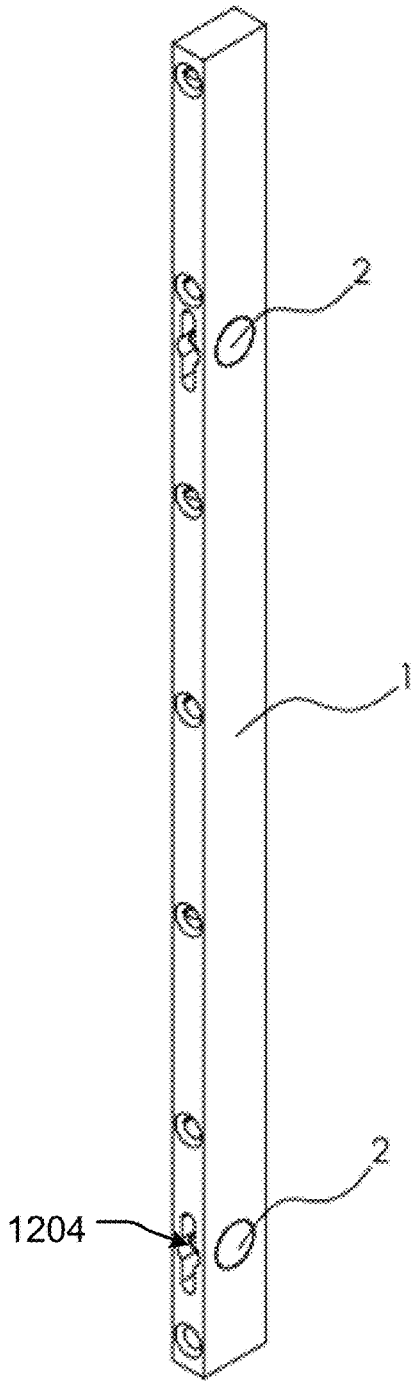
FIG. 21A depicts another example of a stair loom member of the railing system in accordance with examples of the present disclosure.
Figure 21B:
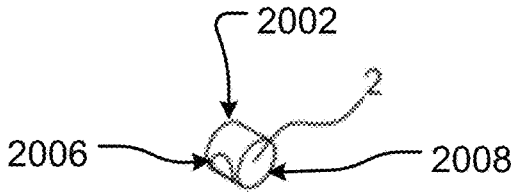
FIG. 21B depicts a pivot bolt in accordance with examples of the present disclosure.
Figure 21C:
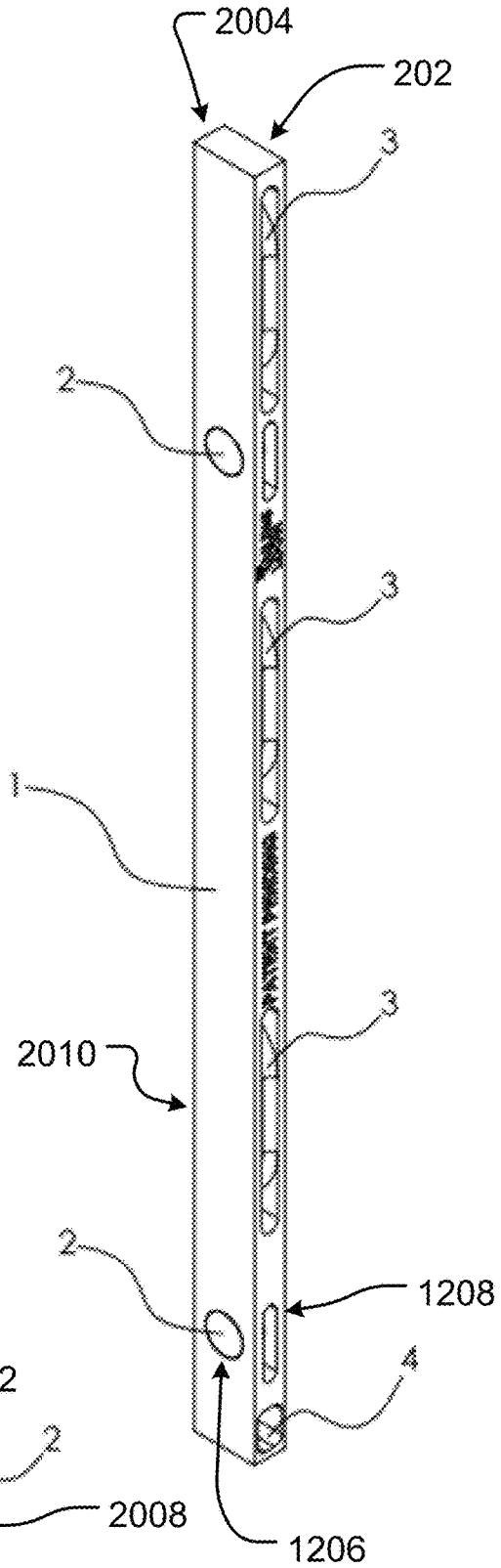
FIG. 21C depicts another example of a stair loom member of the railing system in accordance with examples of the present disclosure.

Implementations of the pivot bolt 2002 may be shown in FIGS. 21A, 21B, and/or 21C. The pivot bolt 2002 may also be a barrel-shaped 2008. The pivot bolt 2002 may have a width equal to width 2004 of the loom member 202. The pivot bolt 2002 can be inserted through the hole 1206. Then, the tensioning device 206 can be inserted through the hole 2006 of the bolt 2002 and screwed into the anchor nut 1712. The bolt 2002 can rotate within opening 2006 to allow the bolt 2002 to attach at an angle from the loom member 202 to the post 102.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more implementations, configurations, or aspects for the purpose of streamlining the disclosure. The features of the implementations, configurations, or aspects of the disclosure may be combined in alternate implementations, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed implementation, configuration, or aspect. Thus, the following claims are hereby incorporated into this Detailed Description, with each claim standing on its own as a separate preferred implementation of the disclosure.

Moreover, though the description of the disclosure has included description of one or more implementations, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative implementations, configurations, or aspects to the extent permitted, including alternate, interchangeable and/or equivalent structures, functions, ranges, or operations to those claimed, whether or not such alternate, interchangeable and/or equivalent structures, functions, ranges, or operations are disclosed herein, and without intending to publicly dedicate any patentable subject matter.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The term "automatic" and variations thereof, as used herein, refers to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

The term "means" as used herein shall be given its broadest possible interpretation in accordance with 35 U.S.C., Section 112(f) and/or Section 112, Paragraph 6. Accordingly, a claim incorporating the term "means" shall cover all structures, materials, or acts set forth herein, and all the equivalents thereof. Further, the structures, materials or acts and the equivalents thereof shall include all those described in the summary, brief description of the drawings, detailed description, abstract, and claims themselves.

Aspects of the present disclosure include a railing system comprising: a first post; a second post; a first loom member coupled to the first post; a second loom member coupled to the second post; and a cable coupled to the first loom member and to the second loom member, wherein the cable spans a gap between the first loom member and the second loom member.

Any of the one or more aspects described herein, wherein the first loom member is coupled to the first post by a tensioning device.

Any of the one or more aspects described herein, wherein the tensioning device is a threaded bolt inserted through an aperture in the first loom member and threaded into a tapped aperture in the first post.

Any of the one or more aspects described herein, wherein the cable is looped between the first loom member and the second loom member.

Any of the one or more aspects described herein, wherein the first loom member, the second loom member, and cable forms a panel.

Any of the one or more aspects described herein, wherein the panel spans at least a portion of a gap between the first post and the second post.

Any of the one or more aspects described herein, wherein the panel include two or more cable length spanning from the first loom member to the second loom member.

Any of the one or more aspects described herein, wherein each cable length is from a different cable.

Any of the one or more aspects described herein, wherein each cable length is from a same cable woven between the first loom member and the second loom member.

Any of the one or more aspects described herein, wherein and end of the cable is secured in the first loom member with a retainer nut.

Any of the one or more aspects described herein, wherein the second loom member is a same configuration as the first loom member but is inverted when installed.

Aspects of the present disclosure include a panel in a railing system, the panel comprising: a first loom member coupled to a first post; a second loom member coupled to a second post; and a cable coupled to the first loom member and to the second loom member, wherein the cable spans a gap between the first loom member and the second loom member.

Any of the one or more aspects described herein, wherein the panel spans at least a portion of a gap between the first post and the second post.

Any of the one or more aspects described herein, wherein the panel includes two or more cable lengths spanning from the first loom member to the second loom member.

Any of the one or more aspects described herein, wherein each cable length is from a different cable.

Any of the one or more aspects described herein, wherein each cable length is from a same cable woven between the first loom member and the second loom member.

Any of the one or more aspects described herein, wherein and end of the cable is secured in the first loom member with a retainer nut.

Aspects of the present disclosure include a loom member of a railing system, the loom member comprising: a first section; a u-shaped section connected to the first section, the u-shaped section having a u-shaped channel from an inlet opening to an outlet opening, wherein the u-shaped section holds a cable length of a cable; and an opening formed in the first section, the opening accepting a tensioning device for coupling the loom member to a post.

Any of the one or more aspects described herein, further comprising: a cable retention opening connected to the first section, the cable retention opening receives a retention device that couple an end of the cable to the loom member.

Any of the one or more aspects described herein, further comprising: one or more other u-shaped sections to thread the cable back and forth between the loom member and a second loom member.

What is claimed is:

1. A railing system comprising:

a first post;

a second post;

a first loom member coupled to the first post, the first loom member substantially parallel to the first post, the first loom member comprising:

a first section, wherein an end of a cable is secured in the first loom member with a retainer nut at a distal end of the first section;

at least a first u-shaped section and a second u-shaped section, the first u-shaped section connected to the first section, each u-shaped section having a u-shaped channel from an inlet opening to an outlet opening, wherein the u-shaped section holds a cable length of the cable in the first loom member; and a second section at least between the first u-shaped section and the second u-shaped section, the second section comprising an opening, the opening accepting a tensioning device for coupling the loom member to a post;

a second loom member coupled to the second post, the second loom member substantially parallel to the second post; and the cable coupled to the first loom member and to the second loom member, wherein the cable is woven between the first loom member and the second loom member to span a gap between the first loom member and the second loom member.

2. The railing system of claim 1, wherein the first loom member is coupled to the first post by the tensioning device.

3. The railing system of claim 2, wherein the tensioning device is a threaded bolt inserted through the opening in the first loom member and threaded into a tapped aperture in the first post.

4. The railing system of claim 1, wherein the cable is looped between the first loom member and the second loom member.

5. The railing system of claim 4, wherein the first loom member, the second loom member, and the cable forms a panel.

6. The railing system of claim 5, wherein the panel spans at least a portion of a gap between the first post and the second post.

7. The railing system of claim 6, wherein the panel includes two or more cable lengths spanning from the first loom member to the second loom member.

8. The railing system of claim 7, wherein each cable length is from a different cable.

9. The railing system of claim 7, wherein each cable length is from a same cable woven between the first loom member and the second loom member.

10. The railing system of claim 9, wherein a first end of the cable is secured in a first distal end of the first loom member and a second end of the cable is secured in a second distal end of the second loom member.

11. The railing system of claim 1, wherein the second loom member is a same configuration as the first loom member but is inverted when installed.

12. A panel in a railing system, the panel comprising:

a first loom member coupled to a first post, the first loom member substantially parallel to the first post, the first loom member comprising:

a first section, wherein an end of a cable is secured in the first loom member with a retainer nut at a distal end of the first section;

at least a first u-shaped section and a second u-shaped section, the first u-shaped section connected to the first section, each u-shaped section having a u-shaped channel from an inlet opening to an outlet opening, wherein the u-shaped section holds a cable length of the cable in the first loom member; and a second section at least between the first u-shaped section and the second u-shaped section, the second section comprising an opening, the opening accepting a tensioning device for coupling the loom member to a post;

a second loom member coupled to a second post, the second loom member substantially parallel to the second post; and a cable coupled to the first loom member and to the second loom member, wherein the cable spans a gap between the first loom member and the second loom member, wherein an end of the cable is secured in the first loom member with a retainer nut.

13. The panel of claim 12, wherein the panel spans at least a portion of a gap between the first post and the second post.

14. The panel of claim 12, wherein the panel includes two or more cable lengths spanning from the first loom member to the second loom member.

15. The panel of claim 14, wherein each cable length is from a different cable.

16. The panel of claim 15, wherein each cable length is from a same cable woven between the first loom member and the second loom member.

17. The panel of claim 12, wherein a first end of the cable is secured in a first distal end of the first loom member and a second end of the cable is secured in a second distal end of the second loom member.

18. A loom member of a railing system, the loom member comprising:

a first section, wherein an end of a cable is secured in the loom member with a retainer nut at a distal end of the first section;

a first u-shaped section connected to the first section, the first u-shaped section having a first u-shaped channel from an inlet opening to an outlet opening, wherein the first u-shaped section holds the cable length of a cable; and a second section at least between the first u-shaped section and a second u-shaped section, the second section comprising an opening, the opening accepting a tensioning device for coupling the loom member to a post.

19. The loom member of claim 18, further comprising: a cable retention opening connected to the first section, the cable retention opening receives a retention device that couples an end of the cable to the loom member.

20. The loom member of claim 18, further comprising: one or more other u-shaped sections to thread the cable back and forth between the loom member and a second loom member.

* * * * *